US007086921B2

(12) United States Patent
Kuegler

(10) Patent No.: US 7,086,921 B2
(45) Date of Patent: Aug. 8, 2006

(54) ROCKING TOY FOR CHILDREN

(76) Inventor: Jost-Ulrich Kuegler, Im Teelbrush 61, D-45219 Essen (DE)

( * ) Notice: Subject to any disclaimer, the term of this patent is extended or adjusted under 35 U.S.C. 154(b) by 0 days.

(21) Appl. No.: 10/790,616

(22) Filed: Mar. 1, 2004

(65) Prior Publication Data

US 2004/0259461 A1 Dec. 23, 2004

Related U.S. Application Data

(63) Continuation of application No. 09/869,272, filed as application No. PCT/EP99/10482 on Dec. 30, 1999, now abandoned.

(30) Foreign Application Priority Data

Dec. 30, 1998 (DE) ..... 198 60 830

(51) Int. Cl.
*A63H 33/00* (2006.01)
*A63H 3/00* (2006.01)
*A63H 13/18* (2006.01)
*A63H 13/06* (2006.01)

(52) U.S. Cl. ..... 446/29; 446/313; 446/325; 472/102

(58) Field of Classification Search ..... 446/29, 446/313, 325, 326, 346; 472/95, 100, 102; 297/272.1, 272.2; 36/59 R
See application file for complete search history.

(56) References Cited

U.S. PATENT DOCUMENTS 1,383,468 A * 7/1921 Lagelbauer ..... 280/219
1,846,393 A 2/1932 Hankins
2,665,519 A * 1/1954 Burkes ..... 472/129
2,960,345 A * 11/1960 Chontos ..... 280/1.182
3,098,317 A 7/1963 Guzman
5,855,276 A * 1/1999 Smith, Jr. ..... 206/457
6,499,164 B1 * 12/2002 Leach ..... 5/632

FOREIGN PATENT DOCUMENTS

GB 1326711 8/1973

OTHER PUBLICATIONS

International Search Report for PCT Application No. PCT/EP99/10482 (dated Apr. 27, 2000).

* cited by examiner

*Primary Examiner*—Derris H. Banks
*Assistant Examiner*—Faye Francis
(74) *Attorney, Agent, or Firm*—Renner, Otto, Boisselle & Sklar, LLP

(57) ABSTRACT

Children's rocking toy, in particular in the form of a stylized horse, having a one-piece basic body made of flexible synthetic material, a simply curved rocking surface forming the base of the rocking toy and a seat region molded into it. In one refinement, the seat region is molded into it to a sufficient depth that a backrest region is produced. The rocking toy has a horse's head and a horse's rear part which serves as a support for a child situated in the seat. The basic body can consist of foam, in particular of foam rubber. In this case, the basic body is of a Shore hardness sufficient for it to have sufficient stability for rocking and to yield when a child is lying on a side surface of the toy. For further stabilization purposes, the basic body widens in its cross section towards the base. The basic body is preferably manufactured from a foam block and, for further refinement, can have a material covering, if appropriate a slip-on cover.

13 Claims, 1 Drawing Sheet

ROCKING TOY FOR CHILDREN

RELATED APPLICATION

This application is a continuation and claims the benefit of priority under 35 USC 120 of U.S. application Ser. No. 09/869,272, filed Jun. 26, 2001. The disclosure of the prior application is considered part of and is incorporated by reference in the disclosure of this application. This application also claims the benefit of priority under 35 USC 119 of PCT application serial number PCT/EP99/10482, filed Dec. 30, 1999 and German application serial number 198 60 830.6, filed Dec. 30, 1998.

The invention relates to a toy for children.

BACKGROUND OF THE INVENTION

Toys for rocking purposes which are in the form of an animal simulation and on which the child can sit are known. In most cases, the animal is fitted with the runners onto a cradle or onto an undercarriage. German utility model 7403367 discloses a toy which comprises a cradle as the supporting part and a seat which is arranged thereon in the form of an animal figure, with the cradle consisting of a padded body on which the seat is fixed. In this case, the cradle and the seat may consist of a padded body covered by a covering. A U-shaped stiffening frame in the cradle ensures that the toy has a certain stability. German utility model 32987 discloses a one-piece, self-supporting rocking and reclining chair made of foam, in which the angle between the leg and seat surface is more than 90°.

In the case of the known toy there is a considerable risk of injury when children slip under the cradle runners or become caught in the cradle frame. One design, in which the animal skin rests on a padded cradle, results in restricted leg freedom for the child. If the toy is made correspondingly larger, then it is so heavy that the child can only make it rock with difficulty. The stiffening frame in the cradle for stabilization purposes also results in an increase in the overall weight.

Finally, when used by small children the cradle may come into contact with items of furniture and knock them over or damage them in some other manner.

It is also a problem that children who lean too far backwards may fall from the seat, which entails the risk of injuries.

The shaping of the known padded body is brought about by the cut of the covering, and hence the existing seams may tear. There is then the risk of small children swallowing or breathing in the padding material. In addition, the manufacturing process of this known toy is complicated.

OBJECT

The object of the invention is to provide a children's rocking toy which can be produced easily and can be transported and with which the danger posed to its user, generally a small child, when playing and damage to adjacent items of furniture are largely eliminated

SUMMARY OF THE INVENTION

According to the invention, the object is achieved by a children's rocking toy, in particular in the form of a stylized horse, having a one-piece basic body made of flexible synthetic material, a simply curved rocking surface forming the base of the rocking toy and a seat region molded into it.

Expedient further refinements of the rocking toy include one of more the following. The basic body widens in its cross section towards the base. The seat region is molded into the basic body to an extent sufficient to provide a backrest region. The basic body has, at its two longitudinal end regions, two curvatures in the form of a horse's head and a horse's rear part, respectively, with the vertical height of both curvatures being greater than the vertical height of the seat region, so that they form an additional support for a child sitting in the seat region. The material forming the basic body is of a Shore hardness sufficient for the basic body, on the one hand, to have sufficient stability when rocking and, on the other hand, can be deformed in a sufficiently flexible manner so that it yields when a child is resting on one of its side surfaces. The flexible synthetic material is a foam. The basic body is manufactured, in particular cut, from a foam block. The rocking surface has a non-slip backing made of leather or imitation leather. The basic body is covered with a material covering. The seat region has a leather layer as the saddle. The backing is connected to the basic body by a touch-and-close or zip fastener or is buttoned to it (press-stud) or by a strap (or leather strap) with an overhang and eyelet for exchanging or for cleaning or washing purposes. The horse's head has a mane and ears designed as grips, and the horse's rear part has a tail. The horse's rear part has a tail made from the material covering. The tail and the mane of the horse's head consist of real, artificial or stylized hairs. The mane of the horse's head is designed as a pattern imprinted into the material covering. The basic body, which consists of a foam, has, for stabilization purposes, a core that consists of foams of expandable polystyrene.

The advantages which can be achieved by the children's rocking toy according to the invention reside in the fact that its production is facilitated and its stability is increased by the one-piece design.

By means of the use of a flexible synthetic material in the production of the basic body and dimensioning of its size, on the one hand, the rocking toy can be used for a child to hop around with feet reaching down to the floor and with his arms around the horse's neck and, on the other hand, the rocking toy can be used tipped over as a base for the child for resting on or sleeping. A child who has slipped under the rocking surface cannot be injured. Furthermore, damage to items of furniture is not possible. Contact even with relatively small items of furniture, such as vases and the like, by the rocking toy is largely harmless.

The molded-in seat region gives more support in particular to a small child using the rocking toy, so that the child largely avoids falling off.

By means of the special design of the basic body the center of gravity of the rocking toy is shifted downwards towards the supporting surface and therefore inadvertent tipping over is prevented. Intended tipping or rolling is possible without danger because of the material and design.

The curvatures in front of and behind the seat surface produce a good support for a child sitting astride the rocking horse. Falling of the child from the seat and resultant injury is therefore largely excluded.

The basic body consists essentially of a foam, specifically foam rubber (latex). This material is inexpensive and lightweight in comparison to wood, for example. Compared to soft textile cushions a foam body does not show a tendency to infestation by house mites and is consequently especially suitable for households in which there are people with allergies. Since it absorbs hardly any liquid, it is easy to disinfect and is also suitable for damp locations. An advantageously used covering permits the child's skin to be aerated and prevents excessive formation of sweat on the contact surface between the skin and rocking toy.

In an advantageous refinement of the invention the basic body has a core. The material of this core is harder than the material of the basic body which surrounds the core. The core material is preferably particle foams made of expandable polystyrene (for example styropor). The core brings about an additional increase in the stability without substantially increasing the weight of the rocking toy.

An embodiment of the rocking toy according to the invention is explained in greater detail below with reference to the attached drawing, in which:

DESCRIPTION OF PREFERRED EMBODIMENT

Figure 1:
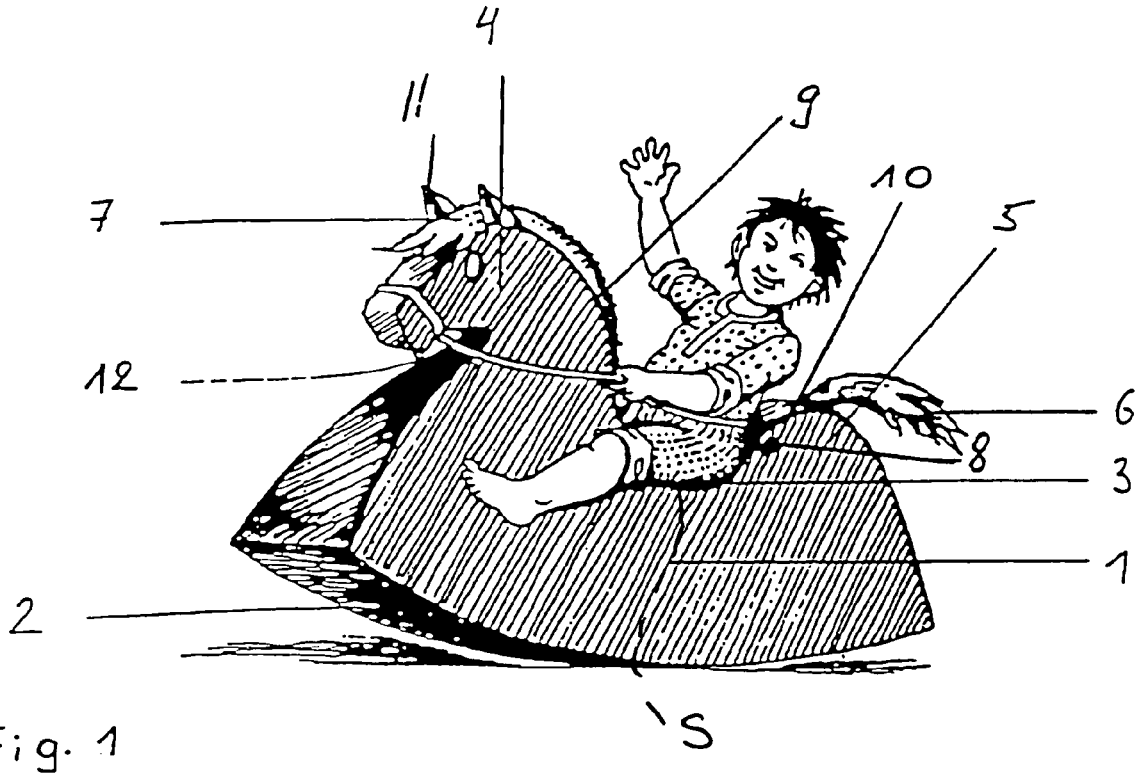
FIG. 1 shows a perspective view of the rocking toy.
Figure 2:
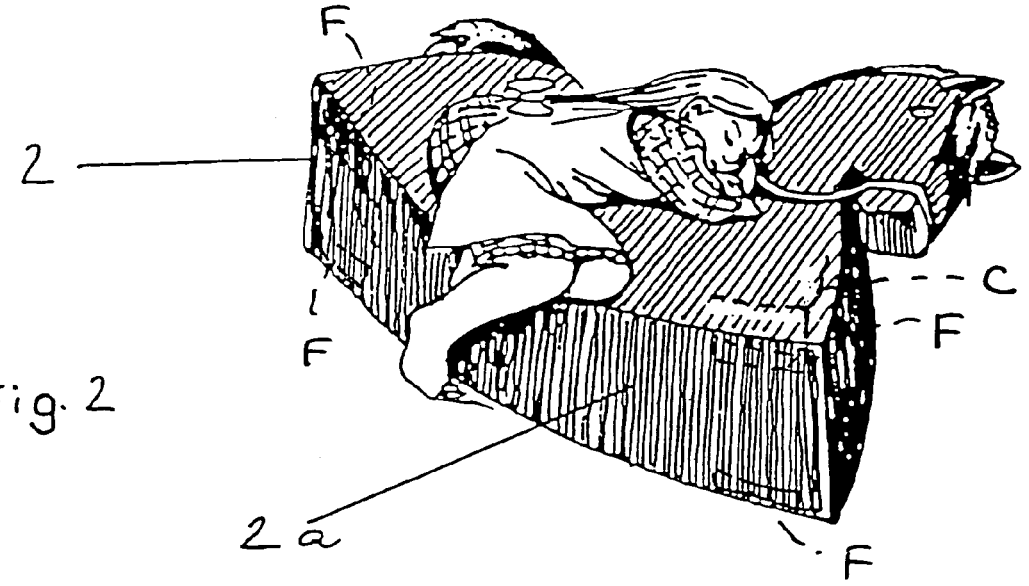
FIG. 2 shows, perspectively, the rocking toy, according to FIG. 1 lying on a side surface.

The rocking toy according to FIG. 1 has the form of a stylized horse having a one-piece basic body 1 made of a flexible foam and a simply curved rocking surface 2 and also a seat region 3 molded into it. The basic body widens in its cross section towards the base. The seat region 3 is molded into the basic body 1 to an extent sufficient to provide a backrest region 8. The basic body 1 has two curvatures 9, 10, one on each side of the seat region 3, which curvatures are designed as a horse's head 4 and as a horse's rear part 5. These curvatures 9, 10 form an additional support for the child sitting in the seat region 3. The Shore hardness of the foam of the basic body 1 is selected in such a manner that the basic body, on the one hand, has sufficient stability during rocking (FIG. 1), and, on the other hand, adequately yields in order to provide a comfortable base for a child lying on a side surface of the rocking toy (FIG. 2). The basic body 1 is manufactured, for example cut, from a foam block, or is cast in a mold. In a further embodiment, the basic body is enclosed by a slip-on cover.

In the case of the rocking toy according to FIG. 2, a side surface is used as a sleeping base for the child. It is also possible to manufacture the rocking toy in such a manner that it can be recognized as a black horse, brown horse, fox, white horse or zebra.

A non-slip backing 2*a* is provided on the rocking surface. The tail 6 and mane 7 of the horse are manufactured from artificial hairs. In a further embodiment (not shown), the tail 6 and mane 7 are manufactured from stylized hairs (for example, from cord). The horse's head 4 also has two laterally fitted eyes, either as depressions in the basic body (as shown in FIGS. 1 and 2) or in the form of two eyes sewn on at the sides or set in (not shown). A bridle 12 is placed around the horse's head 4. If appropriate, the seat region 3 can be covered by a saddle (not shown). The horse's head is also provided with ears 11 which are used as grips.

The invention claimed is:

1. Children's rocking toy in the form of a stylized horse, having a one-piece basic body made of flexible synthetic material which has a simply curved rocking surface forming the base of the rocking toy and a seat region molded into it, the basic body forming in its tipped over side position a reclining or sleeping base for a child, characterized in that the seat region is molded a good distance into the basic body and thereby forms a backrest region, in that the basic body has, at its two longitudinal end regions, two curvatures in the form of a horse's head and of a horse's rear part, respectively, with the height of both curvatures being greater than the depth of the molded-in seat region, as a result of which an additional support for a child sitting in the seat region is formed, in that the cross section of the basic body widens from its upper, narrow side, which forms the horse's head, seat region and horse's rear part, towards the curved rocking surface in a continuous and uniform contour of the side surfaces, and in that the rocking surface has a non-slip backing made of leather or imitation leather.

2. Children's rocking toy according to claim 1, characterized in that the flexible synthetic material is of a Shore hardness sufficient for the basic body, on the one hand, to have sufficient stability when rocking and, on the other hand, can be deformed in a sufficiently flexible manner so that it yields when a child is resting on one of its side surfaces.

3. Children's rocking toy according to claim 1 or 2, characterized in that the flexible synthetic material is a foam.

4. Children's rocking toy according to claim 1 or 2, characterized in that the basic body has a core whose material is harder than the flexible synthetic material surrounding it.

5. Children's rocking toy according to claim 4, characterized in that surrounding it, the core of the basic body consisting of foams made of expanded polystyrene.

6. Children's rocking toy according to claim 3, characterized in that the basic body is manufactured, in particular cut, from a foam block.

7. Children's rocking toy according to claim 1, characterized in that the basic body is covered with a material covering.

8. Children's rocking toy according to claim 1, characterized in that the seat region has a leather layer as the saddle.

9. Children's rocking toy according to claim 1, characterized in that the backing is connected to the basic body by a touch-and-close or zip fastener or is buttoned to it for exchanging or for cleaning or washing purposes.

10. Children's rocking toy according to claim 1, characterized in that the horse's head has a mane and ears designed as grips, and the horse's rear part has a tail.

11. Children's rocking toy according to claim 1, characterized in that the horse's rear part has a tail made from the material covering.

12. Children's rocking toy according to claim 10, characterized in that the tail and the mane of the horse's head consist of real, artificial or stylized hairs.

13. Children's rocking toy according to claim 8, characterized in that the mane of the horse's head is designed as a pattern imprinted into the material covering.

* * * * *